United States Patent [19]

Zaagman

[11] 4,051,779

[45] Oct. 4, 1977

[54] PAPER REGISTRATION CONTROL DEVICE FOR PRINTING PRESSES

[75] Inventor: Robert N. Zaagman, Wyoming, Mich.

[73] Assignee: MRC Manufacturing Co., Grand Rapids, Mich.

[21] Appl. No.: 690,378

[22] Filed: May 27, 1976

[51] Int. Cl.[2] ..... B65H 9/06; B65H 9/14

[52] U.S. Cl. ..... 101/242; 271/226

[58] Field of Search ..... 271/274, 226, 229, 236, 271/238, 234, 235, 239, 240, 160, 137, 230; 101/232, 239, 241, 242

[56] References Cited

U.S. PATENT DOCUMENTS

| | | | |
|---|---|---|---|
| 742,641 | 10/1903 | Harris | 271/236 |
| 1,300,235 | 4/1919 | Anderson | 271/236 |
| 2,135,206 | 11/1938 | Backhouse | 271/230 |
| 2,938,723 | 5/1960 | Paulson | 271/240 |
| 3,741,536 | 6/1973 | Anderson | 271/274 |

OTHER PUBLICATIONS

IBM Technical Disclosure Bulletin, vol. 16, No. 9, (Feb., 1974).

*Primary Examiner*—J. Reed Fisher

*Attorney, Agent, or Firm*—Price, Heneveld, Huizenga & Cooper

[57] ABSTRACT

A paper registration control device for printing presses includes a carrier having a plurality of holes extending vertically therethrough and arranged in tandem and a plurality of spherical pressure elements, each element adapted for seating in one of the carrier holes. A segment of each of the pressure elements projects below the carrier and floats within the carrier to thereby exert a constant pressure on paper being fed into the registering position. At least one of the spherical pressure elements has a weight different from the other pressure elements. Therefore, the pressure elements may be arranged in different patterns along the carrier to exert the optimum pressure necessary to provide exact register at substantially increased feed rates.

2 Claims, 9 Drawing Figures

PAPER REGISTRATION CONTROL DEVICE FOR PRINTING PRESSES

BACKGROUND OF THE INVENTION

This invention relates to paper registers for printing presses and more particularly, to a unique control structure for such paper registers.

Paper registers are employed in conjunction with a wide variety of printing presses. These devices are required to insure that individual sheets of paper are properly aligned or in register prior to entering the printing press. Proper register is critical to the printing operation. In the area of multicolor printing, such as that accomplished with offset presses, the individual sheet is often run through the printer a plurality of times. Therefore, it must be in exact register during each step of the color printing in order to insure proper overlay of the colors. Also, exact register is a must when printing business forms where several sheets are to be employed.

Present registers generally include a plurality of forward or head stops positioned just upstream of the printer and a pair of side guide blocks or side registers. The head stops and side guide blocks are adjustable to place the sheets in proper register prior to entry into the printer. In a typical press, an automatic paper feed will pick up a single sheet of paper and feed it into the register. The register includes one or more belt-type drive elements which feed the paper in a forward direction until it abuts the head stops. The head stops locate the paper in the direction of movement. The paper's forward movement is then stopped and one of the side guides will automatically shift laterally to place the paper in proper position or register cross-wise of the direction of movement. In order to prevent wrinkling, buckling, or skewing of the paper during the shifting phase of the registration process, one or more paper control devices are employed. These control devices exert a downward pressure on the paper to prevent buckling which may result from the paper lifting off the feed bed of the register.

The paper controls have taken various forms including that of metal straps. These straps require adjustment in order to accommodate and exert the proper pressure for the particular size, weight and thickness of the paper employed. Further, these metal straps have a tendency to produce static electricity which may result in improper paper registration or wrinkling of the paper. Also, wheel arrangements have been employed. These wheels similarly require adjustment for the various weights of paper employed. The adjustments necessary for proper operation are time consuming and the controls themselves limit the maximum feed rates obtainable. The wheels also have an adverse effect upon side guide register operation which again reduces or limits feed rates.

In prior registers, "end bounce" has reduced feed rates. This end bounce is caused by the paper hitting the head stops and in effect bouncing back resulting in buckling or wrinkling. Further, since sheets may vary in size even within the same shipping case, "back trim" has been a substantial problem in the industry. When register is controlled by wheels on the back of the feed mechanism, the sheets must be trimmed to the same exact size (back trimmed) for proper register.

The problems experienced with proper adjustment of the control devices are further aggravated by the fact that the paper may vary in thickness within the tolerances specified for a nominal paper thickness. As a result of this variance, the pressure exerted on a paper by the metal straps or the wheel arrangements may vary during operation and can result in wrinkling of the paper. In an attempt to alleviate this problem, a control device in the form of a carrier having a plurality of holes has been employed. A plurality of equal weight and equal diameter spherical pressure elements or balls, such as marbles, are arranged in tandem within the holes. The carrier is mounted over the feed bed and the spherical pressure elements are permitted to float in a vertical direction to compensate for the thickness variation in the paper stock. Also, since the marbles will rotate universally, resistance to sidewise shifting of the paper in the register is reduced which in turn reduces the occurrence of wrinkling. Although this form of paper control device is superior in performance to the metal strap and wheel structures, such ball type devices exert the same pressure along their lengths regardless of the thickness or weight of paper employed. As a result, the maximum feed rates obtainable will vary with the particular type of paper used.

Another factor significantly affecting the rate at which paper can be fed to a press using conventional control devices is humidity. Changes in humidity require adjustment of the register control devices and changes in the feed rate or both. Both of these requirements reduce the productive capacity of the press.

SUMMARY OF THE INVENTION

In accordance with the present invention, a unique paper registration control device for printing presses and method for controlling paper is provided whereby both a significant increase in feed rates and a substantial reduction in set-up time are obtained. Essentially, the paper registration control includes a carrier having a plurality of holes extending vertically therethrough and arranged in tandem. A plurality of spherical pressure elements are provided. Each element seats in one of the carrier holes with a segment of each element projecting below the carrier. At least one of the pressure elements has a weight different from the others so that the pressure elements can be arranged in different patterns along the carrier. By arranging the spherical pressure elements in different patterns, the pressure exerted on the paper may be varied as a function of the paper weight. Inasmuch as the present invention permits the optimum pressure to be exerted on the particular weight of paper, the feed rate may be drastically increased from that heretofore possible.

The method contemplates varying the number, weight, size and pattern of a plurality of pressure elements as a function of the paper weight so that a significant and unexpected increase in feed rates is obtained.

DETAILED DESCRIPTION OF THE PREFERRED EMBODIMENT

Figure 1:
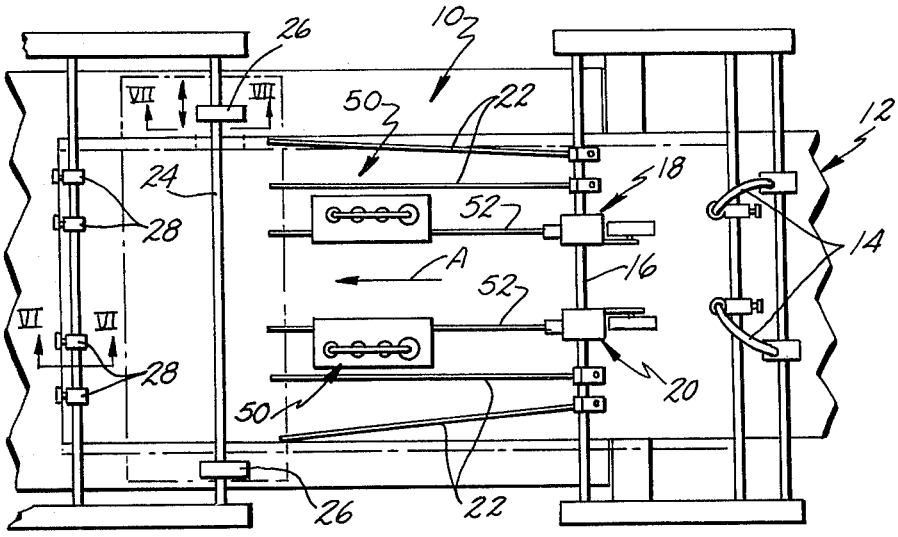
FIG. 1 is a fragmentary, plan view of a printing press including a paper register which incorporates the paper control device in accordance with the present invention.

With reference to the drawings, FIG. 1 illustrates a portion of a printing press which includes a paper register generally designated 10. Individual sheets of paper 12 are fed from a stack or pile to the paper register by conventional, automatic suction heads 14. The paper register includes a conventional paper feed (not shown) which engages each individual sheet of paper and feeds the paper in the direction of arrow 15 over a generally flat supporting surface towards the printing press. A transversely positioned bar 16 at the inlet of the register supports a pair of guide wheel assemblies 18, 20 and a plurality of spring steel fingers 22. Downstream of the inlet guide wheels 18, 20 is positioned a transversely extending rod 24. Slidably mounted on the rod 24 are a pair of spaced, side guides 26. The guides 26 are shiftable transversely of the register in a conventional fashion. Positioned downstream from the side registers 26 are a plurality of head stops 28.

Figure 7:
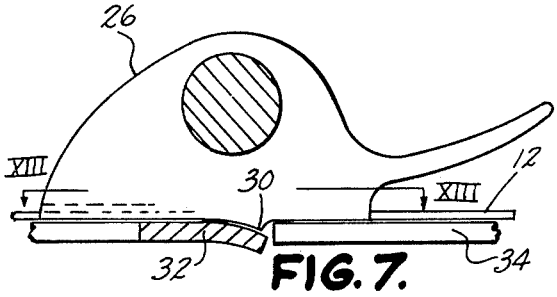
FIG. 7 is a sectional view taken generally along line VII—VII of FIG. 1.
Figure 6:
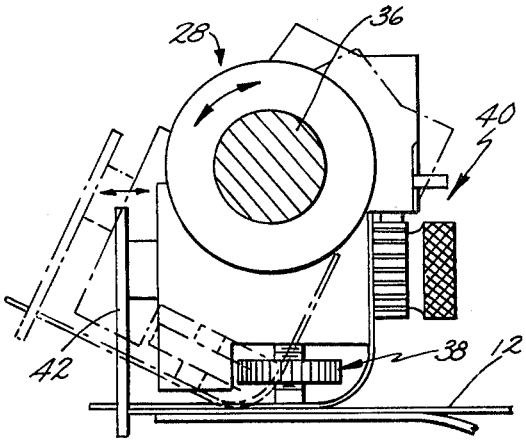
FIG. 6 is a sectional view taken generally along line VI—VI of FIG. 1.
Figure 8:
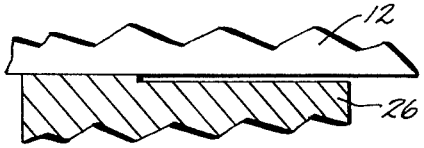
FIG. 8 is a sectional view taken generally along live VIII—VIII of FIG. 7.

As best seen in FIG. 7, each of the side guides 26 includes a downwardly extending lip 30. The lip rides on a downwardly angled lower guide tongue 32 formed in the register feed bed 34. This arrangement insures that the side guides will engage the paper 12 along its lateral edge for shifting the paper into register. As best seen in FIG. 6, each head stop 28 is rotatable upon a transversely extending shaft 36. A mechanism 38 is provided for vertical adjustment of the head stop relative to the feed bed and another mechanism 40 is provided for front and back adjustment of the head stop. Each head stop includes a guide stop 42 against which the transverse edge of the paper 12 abuts.

The above described structure is conventional in nature and is illustrative of the typical paper register mechanisms presently in use. In operation, the suction heads 14 will lift a single sheet of paper from a pile. The paper will be fed into the register mechanism until it abuts the forward head stops 28. At this point, one or both of the side guides are translated laterally to place the paper in proper register for entry into the printing press. During this operation, vertical pressure must be exerted downwardly on the paper in order to insure that it remains in contact with the feed bed to thereby prevent wrinkling or buckling of the paper. Also, the momentum of the paper must be dissipated to eliminate any bounce and prevent buckling of the paper or wrinkling when it engages the head stops.

As shown in FIG. 1, a typical paper register would require a pair of transversely spaced paper registration control devices 50. Each control 50 is supported on an elongated support member 52 which may be above a feed tape of the typical press.

As best seen in FIGS. 2–5, each paper registration control device includes a carrier 54 having formed therein a plurality of through holes or bores 56, 58, 60 and 62. The holes 56–62 extend all the way through the carrier body and are arranged in a spaced, tandem relationship. The lead hole 56 is of larger diameter than the remaining equal diameter holes 58–62.

In the preferred construction, the carrier 54 is molded from a plastic material such as polypropylene in a simple two-piece mold. It should be understood, however, that the carrier 54 could be fabricated from wood or metal materials.

Figure 3:
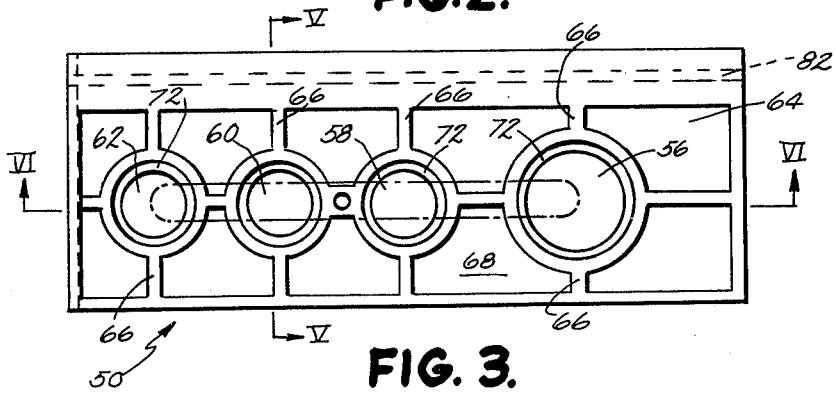
FIG. 3 is a plan view of the unique paper control device in accordance with the present invention.
Figure 4:
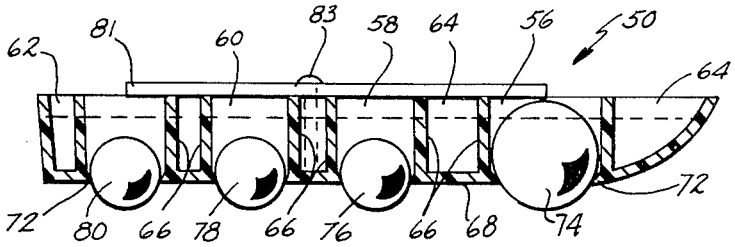
FIG. 4 is a cross-sectional view taken generally along line IV—IV of FIG. 3.

As best seen in FIGS. 3 and 4, the carrier is molded with a plurality of compartments 64 defined by walls 66 and bottom 68. Bottom 68 curves upwardly at the leading transverse edge 70 of the carrier. As a result, the carrier has a general boat-like shape in cross section. The curved leading edge or bow-like portion 70 of the carrier insures that incoming sheets of paper are directed between the carrier and the feed plate when entering the register.

Figure 5:
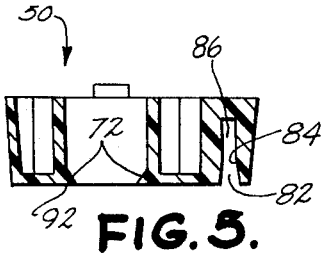
FIG. 5 is a cross-sectional view taken generally along line V—V of FIG. 3.

As best seen in FIGS. 4 and 5, each of through bores or holes 56, 58, 60 and 62, is chamfered or beveled inwardly at its lower end 72 where it passes through the bottom wall 68 of the carrier. The openings defined by the chamfers are smaller in diameter than the diameter of the balls or pressure elements used in the holes. It will be recognized that the same result can be obtained by use of an inwardly extending lip which could be discontinuous - i.e. formed in spaced sections. As a result of this chamfering, spherical pressure elements 74, 76, 78 and 80 will be prevented from passing entirely through the holes 56, 58, 60, 62 respectively. Each spherical pressure element is dimensioned so as to seat against the chamfer 72 with a portion projecting below the carrier. A guard 81 is secured to the top of the carrier as by a screw 83. This guard retains the pressure elements within the carrier when the carrier is being handled by an operator.

Figure 2:
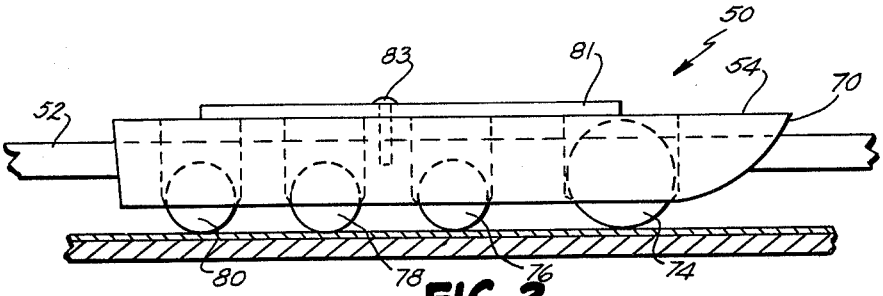
FIG. 2 is an enlarged, fragmentary, side elevational view taken generally along line II—II of FIG. 1.

As best seen in FIGS. 1, 2 and 3, each carrier 54 is formed with an elongated, longitudinally extending, downwardly opening channel or groove 82. The groove 82 which is defined by side walls 84, 86 is dimensioned so as to snugly engage the support member 52 of the paper register. As seen in FIG. 2, when so positioned on the support member 52, the only pressure exerted on the sheet of paper 12 is that exerted by each of the spherical pressure elements. The carrier, therefore, functions merely to position each spherical element for universal rotational movement, to retain the elements in tandem relationship, and to permit vertical motion of eachelement relative to the paper. Each spherical element exerts a constant pressure on the sheet of paper and each element is permitted to move vertically to adjust thereby automatically to variances in paper thickness. These variances in paper thickness may be the result of normal manufacturing tolerances or may be the result of a certain amount of swelling of the paper fibers which will occur under very moist or humid conditions. Further, since forward register is controlled by the head stops 28 acting on the sheet being printed instead of by wheels at the back of the feed mechanism, back trim is eliminated.

In the preferred construction, a plurality of spherical pressure elements or balls are formed from steel while a plurality of the spherical elements are formed from glass. By altering the pattern or arrangement of the steel and glass pressure elements and by eliminating or not placing a spherical element in one of the through holes, feed rate increases of approximately 40% or more in excess of those presently available may be obtained for a wide variety of paper weights.

In the preferred embodiment, the larger diameter steel balls insertable in the through hole 56 have a diameter of 13/16 inch and a weight of approximately 1½ oz. The smaller diameter steel pressure elements insertable in the through holes 58, 60 and 62 have a diameter of 19/32 inch and a weight of approximately ½ oz. The larger diameter glass balls have a diameter of ⅞ inch and a weight of approximately ½ oz. Finally, the smaller diameter glass balls have a diameter of ⅝ inch and a weight of approximately ⅛ oz. The chamfered holes of the carrier are dimensioned to provide a 3/16 inch drop or extension below the bottom of the carrier. By employing the unique paper control device in accordance with the preferred embodiment of the present invention in the combinations shown in FIG. 9, the feed rates for an ATF Chief 22 offset printing press were increased from around 3200 inpressions per hour to 6000 impressions per hour.

Figure 9:
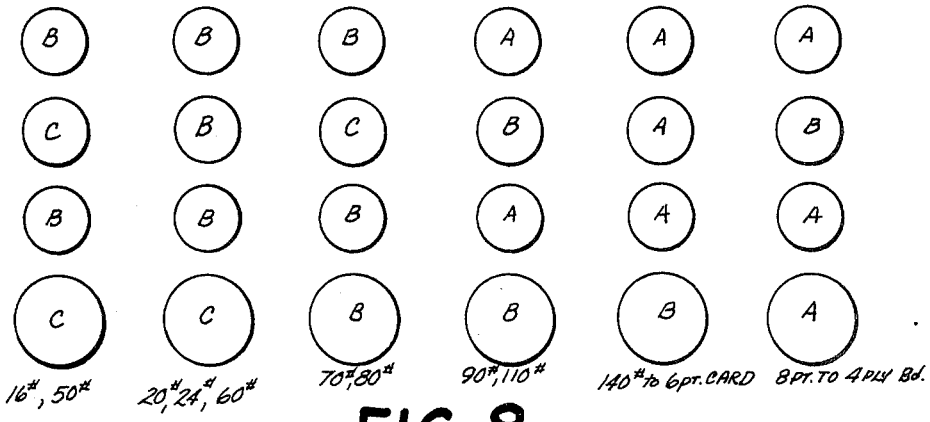
FIG. 9 is a tabulation of spherical pressure element combinations for different paper weights.

In FIG. 9, the reference letter A indicates a steel ball, the reference letter B indicates a glass ball, and the reference letter C indicates the absence of any spherical element.

With 16# and 50# paper, the smaller diameter spherical elements formed from glass are placed only in the through holes 58 and 62. No pressure elements are placed in through holes 56, 60. With 20#, 24# and 64# paper, glass pressure elements are placed only in through holes 58, 60 and 62.

With 70# and 80# paper, glass spherical pressure elements are placed in through holes 56, 58 and 62. It has been found that as higher weight paper is employed, a larger spherical pressure element is placed within the larger cavity or through hole 56 to obtain the increased feed rates.

With 90# and 110# paper, glass spherical pressure elements are placed within through holes 56 and 60, while steel pressure elements are placed in through holes 58, 62. With paper weights varying from 140# to 6 pt. card, the larger glass spherical pressure element is placed in through hole 56 while steel pressure elements are placed within the smaller, equal diameter through holes 58, 60 and 62.

With paper weights varying in the range of 8 pt. to four-ply board, steel pressure elements are placed in through holes 56, 58 and 62 while a glass pressure element is placed in through hole 60. It is preferred for optimum performance that the emphasis should be placed on use of glass balls as much as possible.

The specific combinations for presses other than the ATF Chief 22 will, of course, vary somewhat from those set forth in FIG. 9. The combinations set forth in FIG. 9, however, will serve as a starting point resulting in only minor testing to determine the proper combinations for optimum feed rates.

With previous arrangements, when different weights of stock were used in a press, the wheels or metal straps had to be adjusted and positioned each time. Further, the condition of stock of the same nominal weight would vary and, therefore, one set of values would not work with another batch of stock material. Since the spherical pressure elements are free to float and, therefore, exert a constant pressure on the stock, such variances are automatically compensated for. Further, employing the unique paper control in accordance with the present invention substantially cuts press set-up or make ready time since it is no longer necessary to adjust the wheels and belts. Once the correct combinations of ball weights and types are determined, they can be used over and over for reruns. The use of different size pressure elements as well as pressure elements of varying weight permit an increase of up to 40% and more in the feed rates presently available. Such prior adjustments have basically been intuitive and have required the use of experienced operators to obtain the maximum results. Thus, to be efficient in setting up a press, an operator had to have years of experience and even then had to be vigilant to avoid difficulty. The present invention permits prior tabulation of the appropriate combinations, decreasing trial and error time and permitting accurate set-up by less experienced operators.

It can, therefore, be seen that the unique registration paper control device in accordance with the present invention permits substantially increased feed rates since the pressure elements may be interchanged for weight to accommodate different paper stock. With prior spherical pressure elements or marble controls, the feed rates had to be varied for each stock type. The present invention permits a fairly constant feed rate, substantially higher than heretofore available, with a wide range of paper stock. The time and cost savings to the printer are substantial. Further, the paper control device automatically adjusts for the degree of contact pressure on the paper. Since the pressure elements are spherical and therefore universally rotate, they do not resist side guide operation. This feature eliminates any wrinkling, buckling, or misalignment of the paper during the registration operation. The problems of end bounce and of back trimming are eliminated. The reverse side of each sheet is not marked, wet back-ups are easier and press tapes stay cleaner longer.

It is expressly intended that the above description should be considered as that of the preferred embodiment only. The true spirit and scope of the present invention will be determined by reference to the appended claims.

The embodiments of the invention in which an exclusive property or privilege is claimed are defined as follows.

1. A paper registration control device for use in a printing press of the type including a paper supporting surface over which paper is moved as it enters the press, forward head stops, a rigid bar overlying said feed surface, and a shiftable side guide block and which receives paper from a feed mechanism, said paper registration control device comprising:

an elongated, carrier member including spaced, parallel said members a transversely extending bottom member joining said side members and having an upwardly curved leading edge and a plurality of tandemly arranged holes extending vertically therethrough, each of said holes having an opening of reduced diameter where it opens through the bottom member of the carrier and the one of said holes closest to the leading edge having a diameter greater than the diameter of the remaining holes, said remaining holes being of equal diameter, said carrier member further defining an integral, downwardly opening slot extending longitudinally the entire length of said carrier, said slot being offset laterally from said tandemly arranged holes and dimensioned to receive the rigid bar of the press whereby the carrier is supported on said bar;

a plurality of spherical pressure elements, each disposed in one of said carrier holes and having a diameter slightly greater than the reduced diameter of said opening, a segment of each of said pressure elements projecting below the carrier, at least one of said pressure elements having a diameter and weight different from that of the others, said pressure elements arrangeable in different patterns along said carrier; and guard means extending longitudinally of said carrier over said holes for preventing removal of said pressure elements from the top of said carrier.

2. A paper registration control device as defined by claim 1 wherein some of said spherical pressure elements are formed from glass and wherein some of said spherical pressure elements are formed from steel.

* * * * *

UNITED STATES PATENT AND TRADEMARK OFFICE

CERTIFICATE OF CORRECTION

PATENT NO. : 4,051,779

DATED : October 4, 1977

INVENTOR(S) : Robert N. Zaagman

It is certified that error appears in the above-identified patent and that said Letters Patent are hereby corrected as shown below:

Column 3, line 5:

"live" should be --line--

Column 4, line 48:

"eachelement" should be --each element--

Column 6, line 49:

"said" should be --side--

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*